US008944707B2

(12) United States Patent
Kim

(10) Patent No.: US 8,944,707 B2
(45) Date of Patent: Feb. 3, 2015

(54) PRINTING MEDIUM SUPPLYING UNIT AND IMAGE FORMING APPARATUS HAVING THE SAME

(75) Inventor: Hyun-soo Kim, Youngin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 836 days.

(21) Appl. No.: 12/104,745

(22) Filed: Apr. 17, 2008

(65) Prior Publication Data

US 2009/0010700 A1 Jan. 8, 2009

(30) Foreign Application Priority Data

Jul. 5, 2007 (KR) ..... 10-2007-0067476

(51) Int. Cl.

| | |
|---|---|
| ***B41J 11/58*** | (2006.01) |
| ***B41J 13/10*** | (2006.01) |
| ***B65H 1/26*** | (2006.01) |
| ***B65H 3/66*** | (2006.01) |

(52) U.S. Cl.

CPC ..... *B41J 13/103* (2013.01); *B65H 1/26* (2013.01); *B65H 3/66* (2013.01); *B65H 2404/61* (2013.01); *B65H 2405/113* (2013.01); *B65H 2405/31* (2013.01); *B65H 2801/06* (2013.01)

USPC ..... 400/624; 271/3.08; 271/9.08

(58) Field of Classification Search

USPC ..... 271/9.01, 3.08, 162, 4.01, 4.04, 9.08, 271/117, 105, 31.1, 133, 138, 264; 399/391, 124; 400/624

See application file for complete search history.

(56) References Cited

U.S. PATENT DOCUMENTS

| | | | | |
|---|---|---|---|---|
| 5,277,418 | A * | 1/1994 | Jones et al. | 271/164 |
| 5,294,106 | A * | 3/1994 | Takagi et al. | 271/164 |
| 6,674,983 | B2 * | 1/2004 | Enomoto et al. | 399/124 |
| 6,709,177 | B1 * | 3/2004 | Sugimura | 400/605 |
| 6,984,084 | B2 * | 1/2006 | Ng et al. | 400/624 |
| 2005/0242491 | A1 * | 11/2005 | Howell | 271/167 |

FOREIGN PATENT DOCUMENTS

JP 2004-307135 11/2004

OTHER PUBLICATIONS

Korean Office Action dated Nov. 30, 2011 issued in KR Application No. 10-2007-0067476.

* cited by examiner

*Primary Examiner* — Matthew G Marini
(74) *Attorney, Agent, or Firm* — Staas & Halsey LLP

(57) ABSTRACT

A printing medium supplying unit usable with an image forming apparatus which includes a casing and a feeding unit to feed a printing medium, and the image forming apparatus having the same. The printing medium supplying unit includes a feeding cassette to store and to supply the printing medium; and a guide unit rotatably coupled to the feeding cassette to guide the printing medium to the feeding unit.

10 Claims, 7 Drawing Sheets

FIG. 1
(CONVENTIONAL)
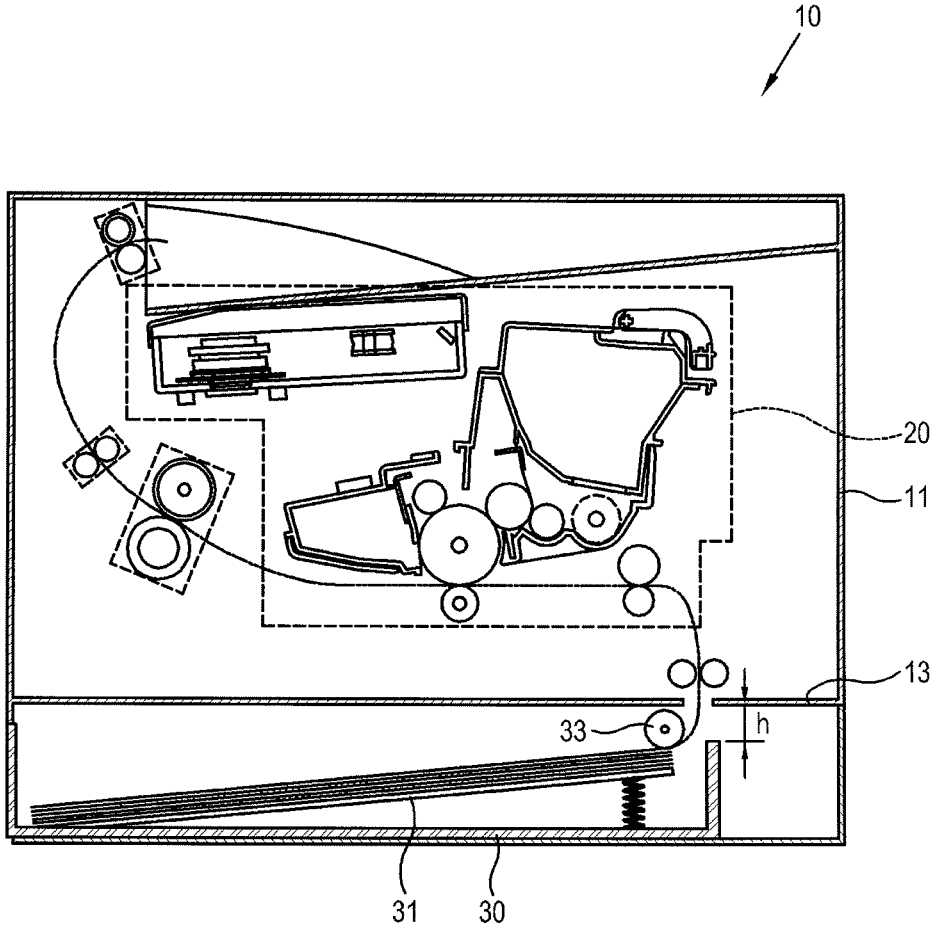

PRINTING MEDIUM SUPPLYING UNIT AND IMAGE FORMING APPARATUS HAVING THE SAME

CROSS-REFERENCE TO RELATED APPLICATIONS

This application claims priority under 35 U.S.C. §119(a) from Korean Patent Application No. 10-2007-0067476, filed on Jul. 5, 2007 in the Korean Intellectual Property Office, the disclosure of which is incorporated herein in its entirety by reference.

BACKGROUND OF THE INVENTION

1. Field of the Invention

Apparatuses and methods consistent with the present general inventive concept relate to a printing medium supplying unit and an image forming apparatus having the same, and more particularly, to a printing medium supplying unit with an improved structure to supply a printing medium and an image forming apparatus having the same.

2. Description of the Related Art

An image forming apparatus forms image data on a printing medium according to a print signal applied from a host apparatus. The image forming apparatus may include a printer, a scanner, a duplicator, a multi-function device, etc.

FIG. 1 schematically illustrates a conventional image forming apparatus 10. As illustrated, the image forming apparatus 10 includes a printing medium supplying unit 30 supplying a printing medium, and an image forming unit 20 forming an image on the printing medium supplied from the printing medium supplying unit 30. Also, the image forming apparatus 10 includes a casing 11 accommodating the printing medium supplying unit 30 and the image forming unit 20.

The printing medium supplying unit 30 feeds the printing medium to the image forming unit 20 when the print signal is applied. If the printing medium stored in the printing supplying unit 30 is used up, the printing medium supplying unit 30 is separated from the casing 11 and then coupled again to the casing 11 after being supplemented with a new printing medium.

The casing 11 accommodates the printing medium supplying unit 30 which is detachably coupled to the casing 11. The casing 11 is designed to form a predetermined gap 'h' between the printing medium supplying unit 30 and a casing wall surface 13, to prevent any interference of the printing medium supplying unit 30 with the casing wall surface 13.

However, when the printing medium supplying unit 30 coupled in the casing 11 feeds the printing medium, there has been a problem that a leading edge of the printing medium leaves a path without being smoothly fed to the image forming unit 20 at the gap 'h' between the printing medium supplying unit 30 and the casing wall surface 13 or a problem that the printing medium is suspended due to a contact with the casing wall surface 13. Also, when the leading edge of the printing medium enters into the image forming unit 20, a trailing edge of the printing medium freely moves at the gap 'h' and raises a problem of an interference with a following printing medium.

SUMMARY OF THE INVENTION

The present general inventive concept provides a printing medium supplying unit and an image forming apparatus having the same that can smoothly and stably feed a printing medium at a gap between a printing medium supplying unit and an accommodating casing.

Additional aspects and/or utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing a printing medium supplying unit usable with an image forming apparatus having a casing and a feeding unit to feed a printing medium, the printing medium supplying unit including a feeding cassette to store and to supply the printing medium, and a guide unit rotatably coupled to the feeding cassette to guide the printing medium to the feeding unit.

The feeding cassette may include a cassette main body detachably coupled to the casing, and a knock-up plate to load the printing medium and to move up and down inside the cassette main body, and the guide unit may be provided at a region in the cassette main body where the printing medium is discharged to the feeding unit.

The cassette main body may include a guide accommodating portion to accommodate the guide unit to rotate so that at least one region of the guide unit is exposed outside from the cassette main body.

The guide unit may include a guide main body rotatably accommodated in the guide accommodating portion and includes a guide surface to guide the printing medium to the feeding unit, and an elastic member provided between the guide main body and the guide accommodating portion to adjust a rotation angle of the guide main body.

The guide main body may include an elastic member coupling hook provided in a lower region of the guide main body to couple one end portion of the elastic member, and the guide accommodating portion may include an elastic member coupling rib to couple an other end portion of the elastic member.

The guide unit may be rotated in an opposite direction to a moving direction of the cassette main body when the cassette main body is separated or coupled.

The printing medium supplying unit may further include an auxiliary feeding cassette provided under the feeding cassette to supply the printing medium to the feeding unit.

The printing medium supplying unit may further include an auxiliary guide unit provided in a feeding path of the printing medium fed from the auxiliary feeding cassette to guide the printing medium to the guide unit.

The auxiliary guide unit may include an auxiliary guide main body having an auxiliary guide surface to guide the printing medium fed from the auxiliary feeding cassette to the feeding unit.

The foregoing and/or other aspects and utilities of the present general inventive concept can be also achieved by providing a image forming apparatus including a casing, a printing medium supplying unit detachably coupled to the casing, the printing medium supplying unit including a feeding cassette to store and to supply a printing medium, and a guide unit rotatably coupled to the feeding cassette to guide the printing medium to a feeding unit, an image forming unit to form an image on the printing medium, and the feeding unit to feed the printing medium fed from the printing medium supplying unit to the image forming unit.

The foregoing and/or other aspects and utilities of the general inventive concept may also be achieved by providing a printing medium supplying unit usable with an image forming apparatus, the printing medium supplying unit including a guide accommodating portion, a guide main body rotatable coupled to the guide accommodating portion to guide the printing medium to a feeding unit of the image forming apparatus, and an elastic member disposed between the guide accommodation portion and the guide main body to adjust a rotational angle of the guide main body.

The printing medium supplying unit can further include an exterior body to detachably mount to the image forming apparatus.

The foregoing and/or other aspects and utilities of the general inventive concept may also be achieved by providing an image forming apparatus including an image forming unit to form an image on a printing medium, a feeding unit to feed the printing medium to the image forming unit and a printing medium supplying unit to supply the printing medium to the feeding unit, the printing medium supplying unit including a guide accommodating portion, a guide main body rotatable coupled to the guide accommodating portion to guide the printing medium to the feeding unit, and an elastic member disposed between the guide accommodation portion and the guide main body to adjust a rotational angle of the guide main body.

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings of which:

FIG. 1 schematically illustrates a conventional image forming apparatus;

DETAILED DESCRIPTION OF THE PREFERRED EMBODIMENTS

Figure 2:
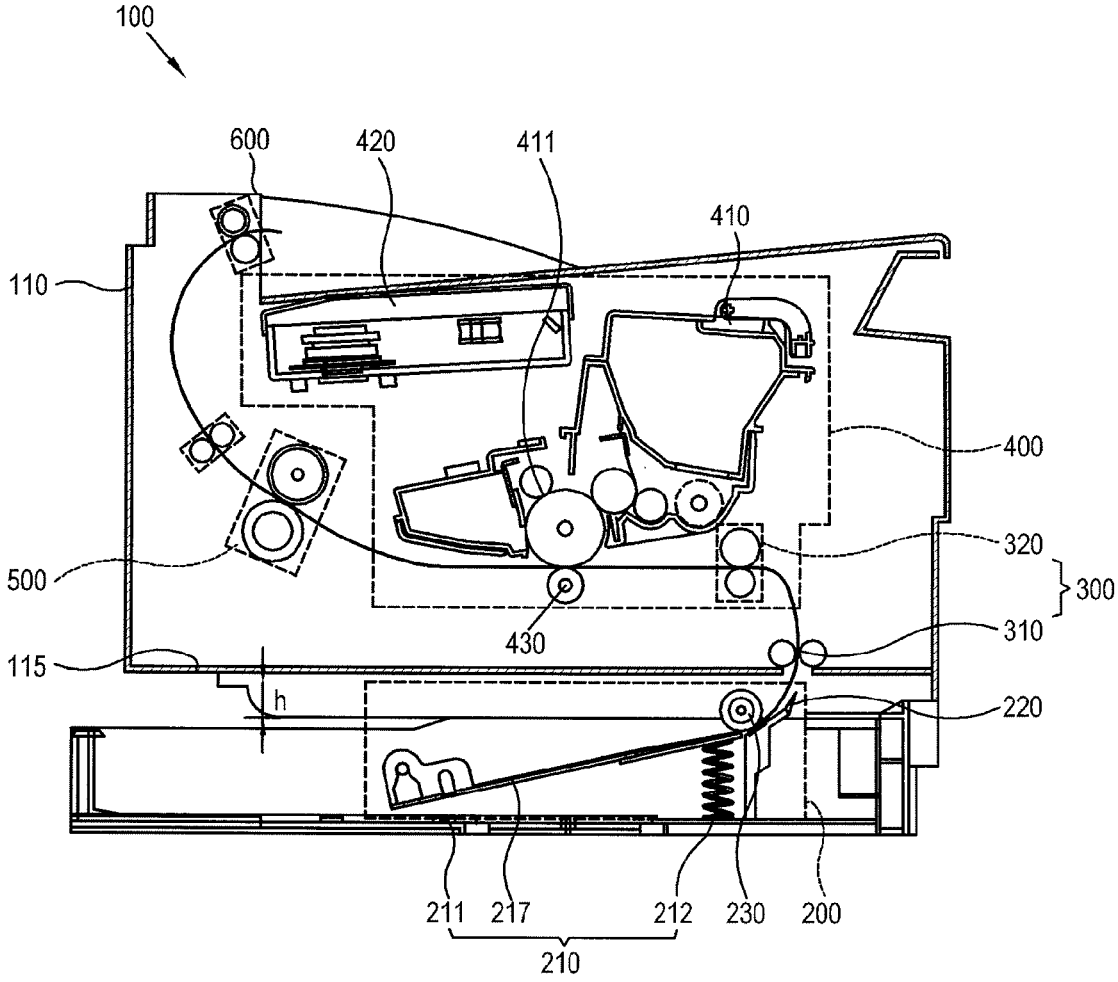
FIG. 2 schematically illustrates an image forming apparatus according to an exemplary embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
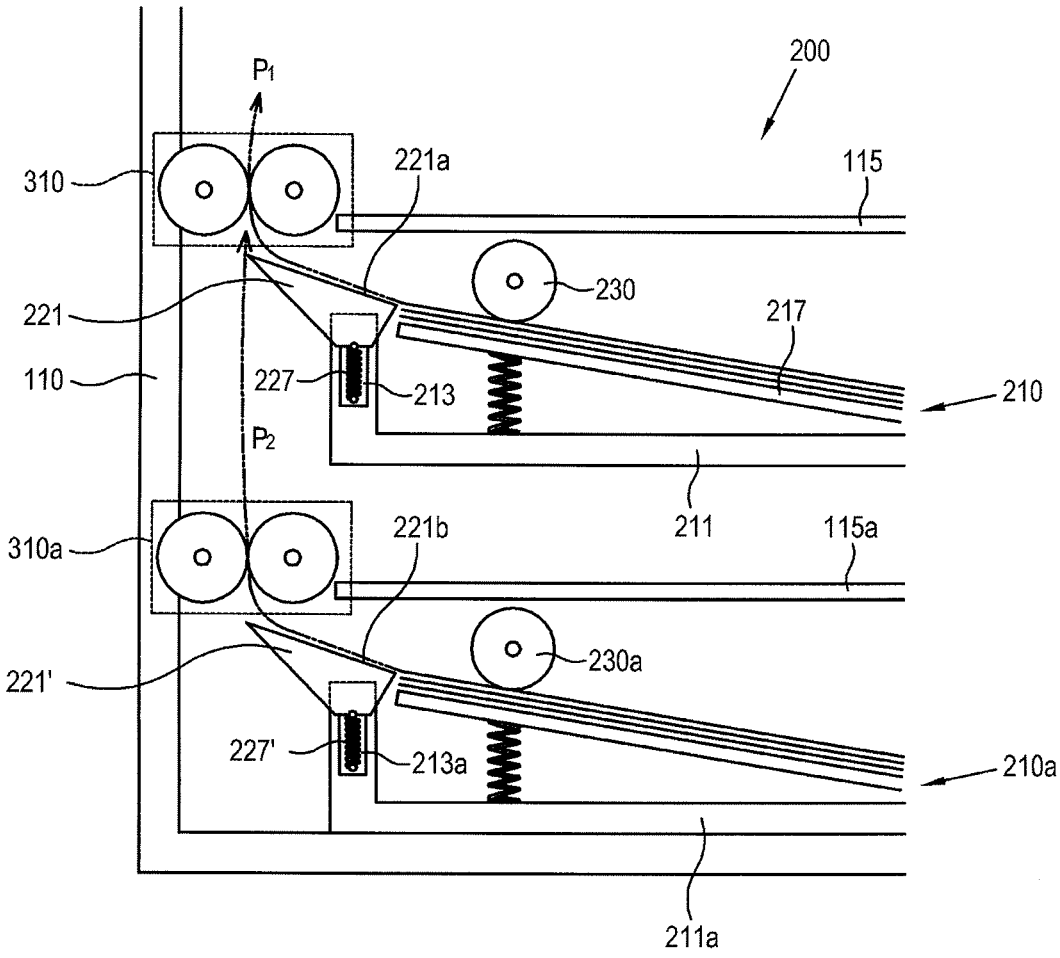
FIG. 3 schematically illustrates a printing medium supplying unit of the image forming apparatus illustrated in FIG. 2.

FIG. 2 schematically illustrates an image forming apparatus 100 according to an exemplary embodiment of the present general inventive concept; and FIG. 3 schematically illustrates a printing medium supplying unit 200. Referring to FIGS. 2 and 3, the image forming apparatus 100 according to the present embodiment includes a casing 110, the printing medium supplying unit 200 to store a printing medium therein and to supply the printing medium, an image forming unit 400 to form an image on the printing medium supplied from the printing medium supplying unit 200, a fusing unit 500 fusing the image on the printing medium, and a discharging unit 600 discharging the image-formed printing medium.

The casing 110 includes an upper casing and a lower casing. The upper casing accommodates the image forming unit 400 and a feeding unit 300 to feed the printing medium. The lower casing is provided under the upper casing and accommodates the printing medium supplying unit 200 which is detachably coupled thereto. The lower casing is provided to form a predetermined gap 'h' with respect to the printing medium supplying unit 200 in order to prevent interference of the printing medium supplying unit 200 with the lower casing when the printing medium supplying unit 200 is separated from or coupled to the lower casing.

The printing medium supplying unit 200 according to the present embodiment includes a feeding cassette 210 and a guide unit 220 rotatably coupled with the feeding cassette 210 to guide the printing medium to the feeding unit 300 in the upper casing. The feeding cassette 210 includes a cassette main body 211 detachably coupled to the lower casing, a knock-up plate 217 provided to move up and down inside of the cassette main body 211, and an elastic member 212 to elastically support the knock-up plate 217.

Figure 4A:
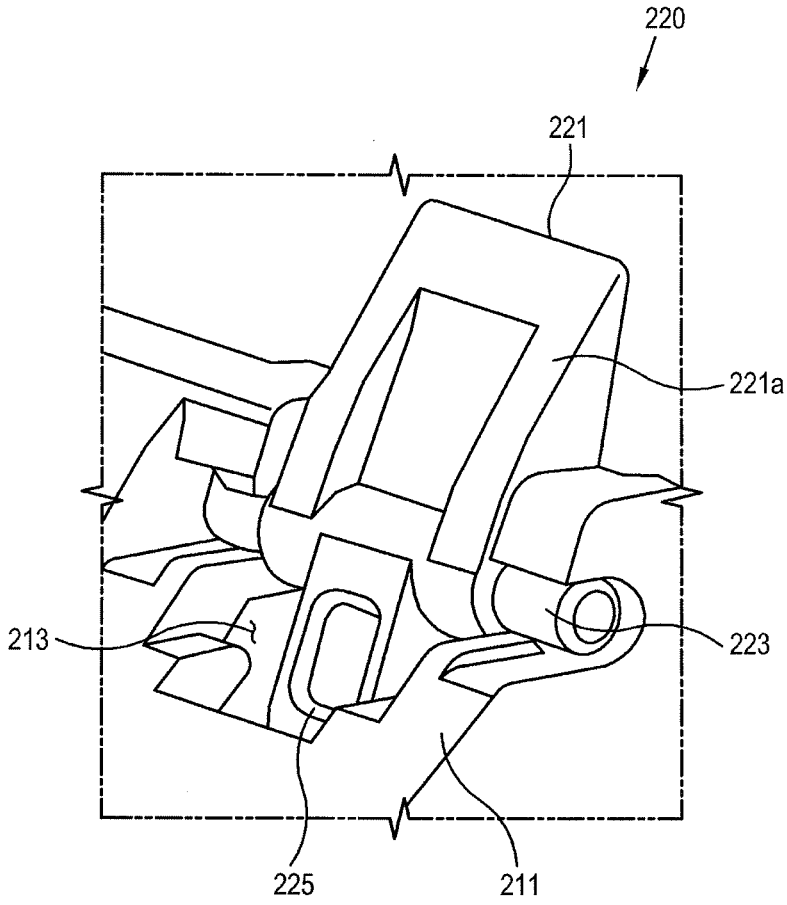
FIGS. 4A and 4B are perspective views illustrating a guide unit of the printing medium supplying unit according to an exemplary embodiment of the present general inventive concept.
Figure 4B:
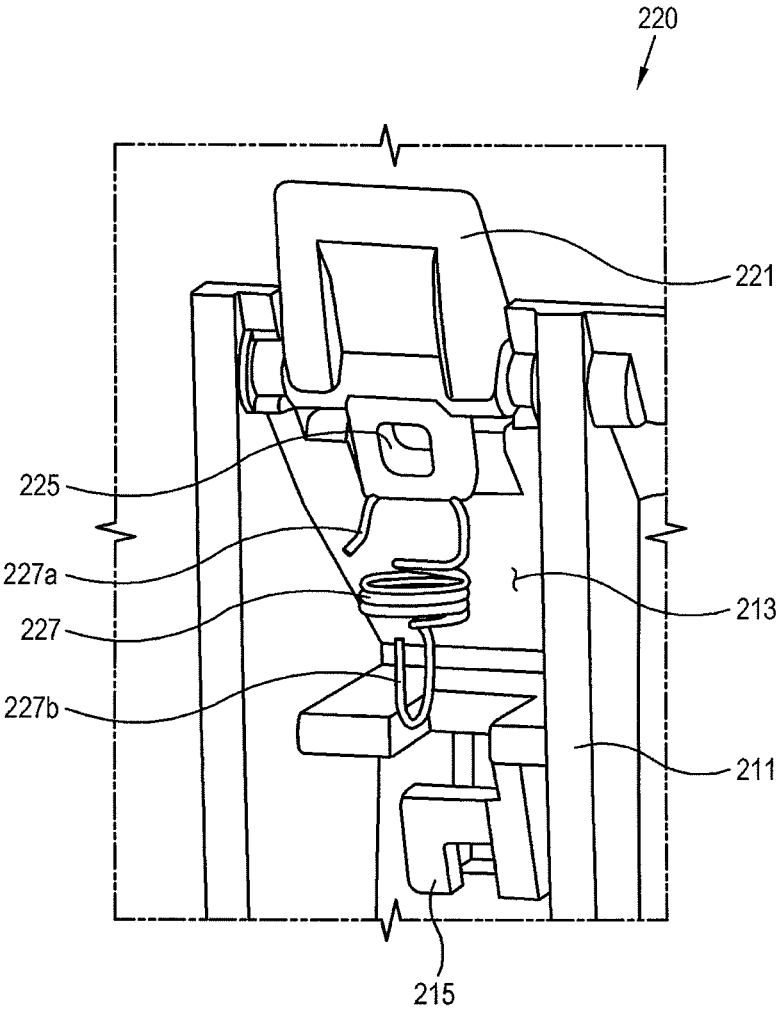

The cassette main body 211 forms space available for the knock-up plate 217 to elevate. The cassette main body 211 is provided in a rectangular shape and, as illustrated in FIG. 3, is formed with a guide accommodating portion 213 to accommodate a guide main body 221 (to be described later) of the guide unit 220 in a region where the printing medium is discharged to the feeding unit 300. As illustrated in FIG. 3 and FIG. 4B, the guide accommodating portion 213 is formed recessed from the cassette main body 211 to accommodate the guide main body 221 to rotate. In the guide accommodating portion 213, an elastic member coupling rib 215 coupling with an elastic member 227 (to be described later) is provided.

The guide accommodating portion 213 is provided to be suitable for a size and a shape of the guide main body 221, and the elastic member coupling rib 215 is protruded from a bottom surface of the guide accommodating portion 213 and coupled to one end portion 227*b* of the elastic member 227.

The guide unit 220 is, as illustrated in FIG. 3 through FIG. 5B, provided on a side of the cassette main body 211 in which the printing medium is fed to guide the printing medium to a feeding roller 310. The guide unit 220 includes the guide main body 221 rotatably coupled to the cassette main body 211, a rotational shaft 223 to support the guide main body 221 to rotate with respect to the guide accommodating portion 213, an elastic member coupling hook 225 provided in one side of the guide main body 221 and coupled with the elastic member 227, and the elastic member 227 to adjust a rotation angle of the guide main body 221.

The printing medium supplying unit 200 may further include a pick-up roller 230 which is coupled to the lower casing and picks up the printing medium loaded in the knock-up plate 217 outside from the knock-up plate 217.

The guide main body 221 is rotatably and elastically coupled to the cassette main body 211, and guides the printing medium picked up by the pick-up roller 230 toward the feeding roller 310. At least one portion of the guide main body 221 is accommodated in the guide accommodating portion 213. A height of the guide main body 221 with respect to the lower casing and an inclined angle of the guide main body 221 may be adjusted by a rotation of the elastic member 227.

The guide main body 221 includes a guide surface 221*a* to guide the leading edge of the printing medium picked up by the pick-up roller 230 to proceed to the feeding roller 310. The guide surface 221*a* can have such an inclined angle that the leading edge of the printing medium when the printing medium is picked up by the pick-up roller 230 and the nip of the feeding roller 310 correspond to each other. That is, the inclined angle of the guide surface 221*a* may be set so that the leading edge of the printing medium which has passed the end portion of the guide surface 221*a* can proceed straight to the nip of the feeding roller 310.

A length of the guide surface 221*a* can correspond to a distance between the feeding cassette 210 and the feeding roller 310. Also, a length of the guide surface 221*a* may be set so that a highest portion of the guide surface 221*a* does not contact the upper casing when the guide main body 221 is rotated to be vertical with respect to a bottom surface of the lower casing.

If the plurality of feeding cassettes 210 is provided in the lower casing as illustrated in FIG. 3, the guide main body 221 may include an auxiliary guide surface 221*b* to stably feed the printing medium fed from a lower feeding cassette 210*a* to the feeding roller 310. The auxiliary guide surface 221*b* guides the leading edge of printing medium fed from below to proceed into the nip of the feeding roller 310. At this time, an inclined angle of the auxiliary guide surface 221*b* may be provided to guide the fed printing medium from below to the nip of the feeding roller 310.

The rotational shaft 223 supports the guide main body 221 to be rotatably coupled to the guide accommodating portion 213.

The elastic member 227 provided between the guide main body 221 and the guide accommodating portion 213 adjusts the rotation angle of the guide main body 221. The one end portion 227*b* of the elastic member 227 and the other end portion 227*a* respectively couple with the elastic member coupling rib 215 and the elastic member coupling hook 225. The elastic member 227 applies an elastic force for the guide surface 221*a* of the guide main body 221 to have the inclined angle to guide the printing medium to the feeding unit 300. That is, the elastic member 227 maintains a position of the guide main body 221 to have the inclined angle to guide the printing medium to the feeding unit 300.

Figure 5A:
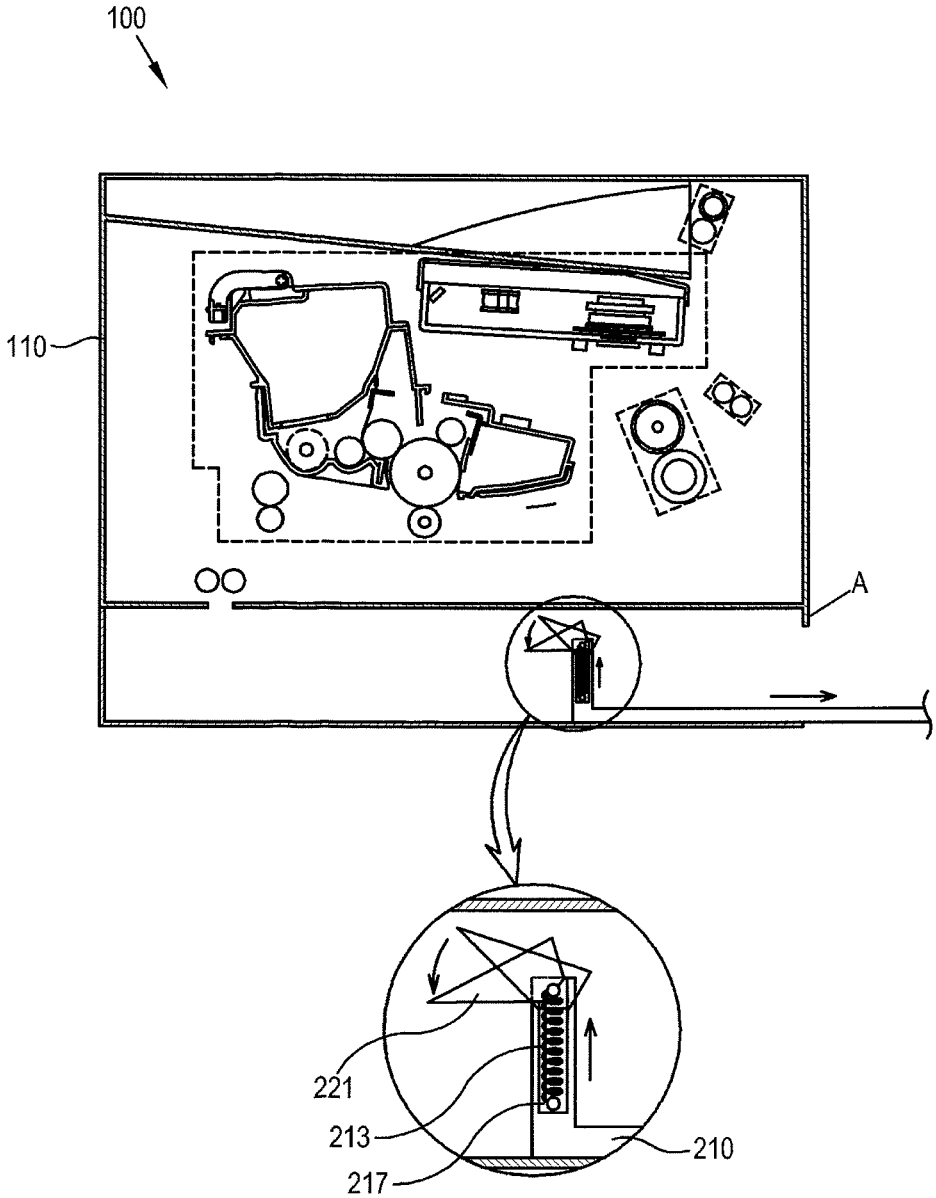
FIGS. 5A and 5B illustrate a rotational operation of the guide unit according to an exemplary embodiment of the present general inventive concept.
Figure 5B:
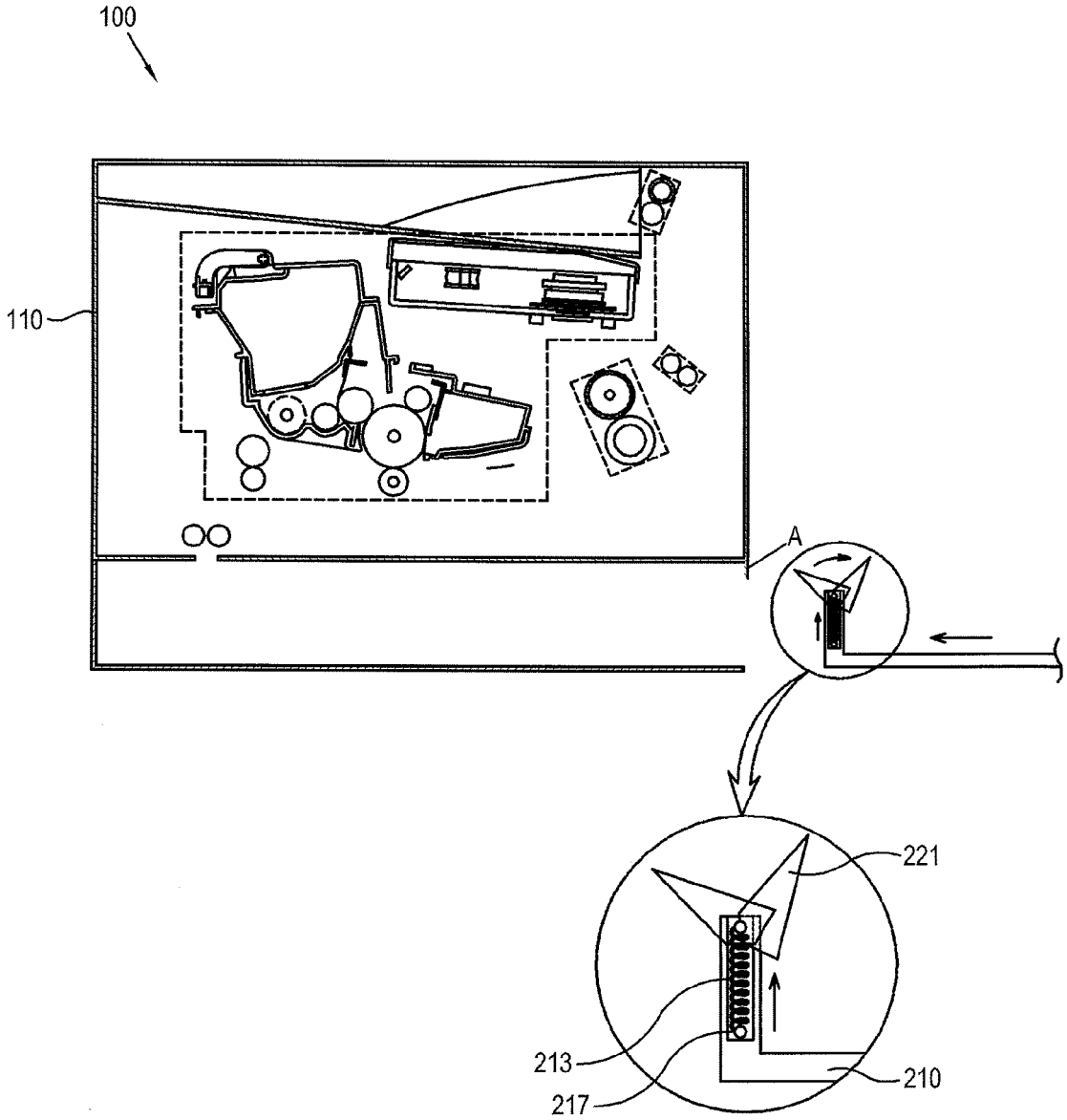

When the cassette main body 211 is separated from the casing 110, the elastic member 227 is extended as illustrated in FIG. 5A to rotate the guide main body 211 downward, that is, opposite to a separating direction of the cassette main body 211 (refer to arrows in FIG. 5A). At this time, the guide main body 221 is rotated in contact with an open region 'A' of the lower casing to allow easy separation of the cassette main body 211 to the outside. Meanwhile, when the separated cassette main body 211 is coupled to the lower casing, the guide main body 221 is rotated in a reverse direction while contacting the open region 'A' to allow smooth coupling of the cassette main body 211 to the lower casing.

The pick-up roller 230 picks up the printing medium that is loaded on the knock-up plate 217 and feeds the printing medium to the feeding unit 300 according to the print signal. The pick-up roller 230 applies a frictional force to the top loaded printing medium by rotationally contacting the printing medium. At this time, the frictional force applied to the top loaded printing medium is larger than a frictional force between the printing media to enable the top loaded printing medium to be fed.

The feeding unit 300 feeds the printing medium guided by the guide unit 220 to the image forming unit 400. The feeding unit 300 includes the feeding roller 310 to feed the printing medium fed by the guide unit 220, and a registration roller 320 to align the leading edge of the printing medium fed by the feeding roller 310. The image forming unit 400 forms an image on the printing medium fed by the feeding unit 300. The image forming unit 400 includes a developing cartridge 410 to spread a developer on the printing medium, an exposure unit 420 to form an electrostatic latent image corresponding to image data on an image receiving body 411 of the developing cartridge 410, and a transfer roller 430 to transfer the developer on the image receiving body 411 to the printing medium by applying a transfer voltage to the printing medium. The fusing unit 500 fuses the developer forming the image on the printing medium through an application of heat and pressure. The discharging unit 600 discharges the image formed printing medium.

An image forming process by the image forming apparatus with the above-described configuration according to the present embodiment will be described with reference to FIG. 2 through FIG. 5B.

A user confirms a loaded amount of the printing medium in the feeding cassette 210. If the printing medium is used up, the printing medium is supplied after separating the feeding cassette 210 from the lower casing. Then, the cassette main body 211 supplied with the printing medium is coupled to the lower casing. At this time, the guide main body 221 is rotated while contacting with the open region 'A' of the lower casing to have a height proper for the cassette main body 211 to be inserted into the lower casing. After the feeding cassette 210 is inserted into the lower casing, the guide main body 221 is restored to the position with the inclined angle to guide the printing medium by the elastic force of the elastic member 227.

When the print signal is applied and the pick-up roller 230 picks up the printing medium, the printing medium is fed along the guide surface 221*a* and proceeds towards the feeding roller 310. At this time, if the printing medium is fed from the lower feeding cassette 210*a* (see FIG. 3), the printing medium is fed along the lower guide main body 221' of the lower feeding cassette 210*a* and the fed printing medium is guided along the auxiliary guide surface 221*b* of the lower guide main body 221' to the feeding roller 310.

The printing medium that proceeds to the feeding roller 310 is fed to the image forming unit 400 via the registration roller 320. The image forming unit 400 forms an image on the printing medium, and then, the image formed printing medium is discharged outside.

As described above, the printing medium supplying unit according to various embodiments of the present general inventive concept includes the guide unit which is provided at a gap between the lower casing and the feeding cassette to guide the printing medium to the feeding unit, thereby stably feeding the printing medium.

As the printing medium is stably fed to the feeding unit by the guide unit, conventional problems like the suspension or interference of the printing medium can be prevented.

Although various exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus having an upper casing and a lower casing and a feeding unit disposed in the upper casing to feed a printing medium, the image forming apparatus comprising:

a printing medium supplying unit comprising:

a pick-up roller to pick up a printing medium;

a feeding cassette to store and to supply the printing medium, the feeding cassette having a main body and a groove to accommodate a rotational shaft; and a guide unit having a rotational shaft rotatably coupled to the feeding cassette in the groove to guide the printing medium picked up by the pick-up roller directly to the feeding unit, where at least one region of the guide unit is exposed outside from an upper portion of the main body of the feeding cassette towards the upper casing;

an image forming unit to form an image on the printing medium; and the feeding unit to feed the printing medium fed from the printing medium supplying unit to the image forming unit, wherein the printing medium supplying unit is detachably coupled to the lower casing of the image forming apparatus and the lower casing has an opening region to accommodate the feeding cassette that is detachably coupled to the lower casing, and wherein the guide unit is configured to rotate in a first direction by contacting a portion of the lower casing defining the opening region when the feeding cassette is detached from the lower casing of the image forming apparatus through the opening region and to rotate in a second direction by contacting the portion of the lower casing defining the opening region when the feeding cassette is inserted in the lower casing of the image forming apparatus through the opening region.

2. The image forming apparatus according to claim 1, wherein the feeding cassette comprises:

the cassette main body detachably coupled to the lower casing; and a knock-up plate to load the printing medium to move up and down inside the cassette main body, and wherein the guide unit is provided at a region in the cassette main body where the printing medium is discharged to the feeding unit.

3. The image forming apparatus according to claim 2, wherein the cassette main body comprises:

a guide accommodating portion to accommodate the guide unit to rotate so that at least one region of the guide unit is exposed outside from the cassette main body.

4. The image forming apparatus according to claim 3, wherein the guide unit comprises:

a guide main body rotatably accommodated in the guide accommodating portion and comprises a guide surface to guide the printing medium to the feeding unit; and an elastic member provided between the guide main body and the guide accommodating portion to adjust a rotation angle of the guide main body.

5. The image forming apparatus according to claim 4, wherein the guide main body comprises:

an elastic member coupling hook provided in a lower region of the guide main body to couple one end portion of the elastic member; and the guide accommodating portion comprises an elastic member coupling rib to couple an other end portion of the elastic member.

6. The image forming apparatus according to claim 1, wherein the guide unit is rotated in an opposite direction to a moving direction of the cassette main body when the cassette main body is separated or coupled.

7. The image forming apparatus according to claim 6, wherein the printing medium supplying unit further comprises:

an auxiliary feeding cassette provided under the feeding cassette to supply the printing medium to the feeding unit.

8. The image forming apparatus according to claim 7, wherein the printing medium supplying unit further comprises:

an auxiliary guide unit provided in a feeding path of the printing medium fed from the auxiliary feeding cassette to guide the printing medium to the guide unit.

9. The image forming apparatus according to claim 8, wherein the auxiliary guide unit comprises:

an auxiliary guide main body having an auxiliary guide surface to guide the printing medium fed from the auxiliary feeding cassette to the feeding unit.

10. An image forming apparatus having an upper casing and a lower casing and a feeding unit disposed in the upper casing, comprising:

an image forming unit to form an image on a printing medium;

a feeding unit to feed the printing medium to the image forming unit; and a printing medium supplying unit to supply the printing medium to the feeding unit, the printing medium supplying unit comprising:

a pick-up roller to pick up the printing medium a feeding cassette having a main body, a guide accommodating portion, and a rotational shaft hole;

a guide main body rotatably coupled to the guide accommodating portion of the feeding cassette via the rotational shaft hole to guide the printing medium picked up by the pick-up roller to the feeding unit directly, where at least one region of the guide main body is exposed outside from an upper portion of the main body of the feeding cassette towards the upper casing; and an elastic member disposed between the guide accommodation portion of the feeding cassette and the guide main body to adjust a rotational angle of the guide main body, wherein the printing medium supplying unit is detachably coupled to the lower casing of the image forming apparatus and the lower casing has an opening region to accommodate the feeding cassette that is detachably coupled to the lower casing, and wherein the guide main body is configured to rotate in a first direction by contacting a portion of the lower casing defining the opening region when the feeding cassette is detached from the lower casing of the image forming apparatus through the opening region and to rotate in a second direction by contacting the portion of the lower casing defining the opening region when the feeding cassette is inserted in the lower casing of the image forming apparatus through the opening region.

* * * * *